United States Patent [19]

Hillenbrand et al.

[11] Patent Number: 5,040,462

[45] Date of Patent: Aug. 20, 1991

[54] APPARATUS FOR PREVENTING SOILING FROM PRINTING MATERIAL

[75] Inventors: Jürgen Hillenbrand, Kirchheim; Franz Waizmann, Gessertshausen, both of Fed. Rep. of Germany

[73] Assignee: Baldwin-Gegenheimer GmbH, Augsburg, Fed. Rep. of Germany

[21] Appl. No.: 431,088

[22] Filed: Nov. 3, 1989

[30] Foreign Application Priority Data

Nov. 15, 1988 [DE] Fed. Rep. of Germany ..... 3838674

[51] Int. Cl.[5] ..... B41F 35/06

[52] U.S. Cl. ..... 101/425; 101/147

[58] Field of Search ..... 101/425, 147

[56] References Cited

U.S. PATENT DOCUMENTS

| | | | |
|---|---|---|---|
| 2,574,002 | 11/1951 | Wiess | 101/425 |
| 4,344,361 | 8/1982 | MacPhee et al. | 101/425 |
| 4,467,719 | 8/1984 | Grosshauser | 101/180 |
| 4,867,064 | 9/1989 | Hara et al. | 101/425 |
| 4,873,925 | 10/1989 | Hultberg et al. | 101/147 |
| 4,922,821 | 5/1990 | Nozaka et al. | 101/425 |

FOREIGN PATENT DOCUMENTS

| | | | |
|---|---|---|---|
| 0119538 | 9/1984 | European Pat. Off. | 101/425 |
| 0257818 | 3/1988 | European Pat. Off. | 101/425 |
| 2538067 | 4/1976 | Fed. Rep. of Germany | 101/425 |
| 2804786 | 8/1979 | Fed. Rep. of Germany | 101/425 |

OTHER PUBLICATIONS

Baldwin Technolog Corp., Automatic Blanket Cleaner, 3/1983.

Xerox Disclosure Journal, vol. 4, No. 2, Mar./Apr. 1979.

*Primary Examiner*—Edgar S. Burr

*Assistant Examiner*—John S. Hilten

*Attorney, Agent, or Firm*—Jones, Tullar & Cooper

[57] ABSTRACT

In the case of a printing press having an impression cylinder for cooperation with at least one transfer cylinder, such as a blanket cylinder, for applying a printing image to a web, a higher degree of quality and greater ease of operation are made possible by having a wiping device with a wiping cloth for engaging the impression cylinder and possibly a bend roll. The wiping device is arranged to act on a part of the periphery of the impression cylinder not having the web of paper trained about it.

8 Claims, 3 Drawing Sheets

2
7a
19
9
8
7
5
4
3
1
6

APPARATUS FOR PREVENTING SOILING FROM PRINTING MATERIAL

BACKGROUND OF THE INVENTION

The invention relates to a printing press and more specifically to a web feed rotary press, comprising at least one impression cylinder arranged to cooperate with at least one transfer cylinder for transfer of the printing image to the web to be printed with an apparatus for preventing soiling of printing material.

In arrangements of this type it frequently occurs that the side of the web engaging the impression cylinder carries a fresh printed image which has not had sufficient opportunity to dry so that there is a risk of the ink soiling the impression cylinder. Experience has shown that solvent contained in the ink collects on the impression cylinder and softens and detaches more and more ink from the printed image on the web. The consequence of this is that the ink deposited on the impression cylinder will be transferred back onto the web in an undesired manner with the result that the web will be soiled and has to be thrown away as reject material. So far it has thus been necessary to halt the press from the to time in order to clean the impression cylinder by hand with a rag. This was not only an awkward operation to perform but furthermore did not prevent any further fouling of the impression cylinder.

SUMMARY OF THE INVENTION

Taking this state of the art as a starting point one object of the invention is thus to provide an arrangement of the type mentioned using simple and inexpensive means so that soiling, at least of the impression cylinder, is precluded.

In order to achieve this or other objects of the invention appearing form the instant specification, claims and drawings, the periphery of at least the impression cylinder is able to be wiped by at least one wiping device comprising a wiping cloth arranged to be moistened, wiping device being arranged in the vicinity of a part of the periphery which is clear of the web trained around the cylinder.

These measures involve the advantage that there is not only a continuous cleaning, but furthermore a continuous moistening of the impression cylinder. The film of moisture on the impression cylinder ensures that the impression cylinder is repellent to ink and thus leads to the further advantage that right form the start there is no deposit of ink on the impression cylinder, or that at any rate there is an effect tending to oppose such ink deposit. Even if under difficult conditions there is a deposition of ink on the impression cylinder, such ink will immediately be wiped off again and the accumulation of the ink is generally discouraged. The features of the invention thus ensure that the impression cylinder is kept clean and that a printing run does not have to be interrupted in order to clean the impression cylinder manually.

It is convenient if the wiping cloth is able to be moistened by a moistening device placed before the position of contact with the impression cylinder, and preferably having spray nozzles directed onto the moistening cloth. These features mean there is practically an indirect moistening of the impression cylinder. The film of moisture on the cylinder may thus be extremely thin so that the web is not unduly weakened by it.

In accordance with a further convenient feature of the invention the wiping cloth is arranged on a pressing member which is adjacent to the position of contact with the impression cylinder and is in the form of an inflatable bellows. These features ensure on the one hand reliable engagement of the wiping cloth and on the other hand make possible disengagement of the wiping cloth from the impression cylinder, this permitting a feed of the wiping cloth in the unloaded state and this relieving of the feeding mechanism.

The moistening may take place using water. In the case of offset litho presses it may be convenient to use the dampening fluid available in the dampening fountain and whose properties make it particularly repellent for ink.

Advantageous further developments of the invention will be gathered from the claims and from the ensuring account of one working example to be seen in the accompanying drawings referring to the accompanying drawings.

DETAILED ACCOUNT OF THE PREFERRED EMBODIMENT

Figure 1:
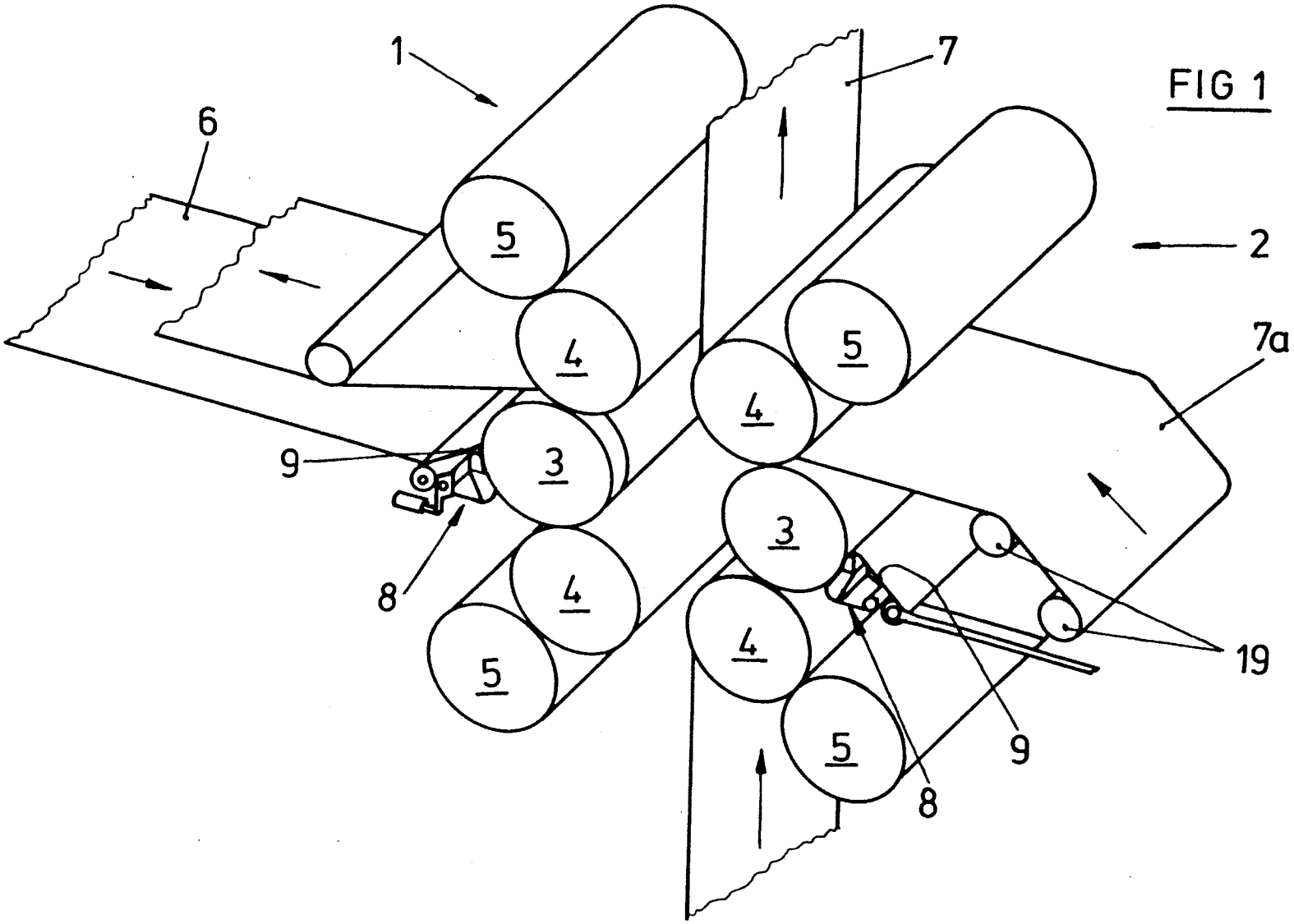
FIG. 1 is a diagrammatic view of a web feed rotary press of the semi-satellite type.

In a generally known manner the printing press shown in FIG. 1 comprises two twin offset litho printing units 1 and 2 each having an impression cylinder 3 which is engaged by two printed image transfer or blanket cylinders 4. The blanket cylinders are arranged for cooperation with a respective plate cylinder 5. Arrangements of this type make possible many different arrangements of the paper in the press. In the illustrated example a paper web 6 and 7, respectively, is being printed on one side in the twin printing units 1 and 2 respectively. Such webs have a short time previously has matter printed on their other sides so that when such sides come into contact with the respective impression cylinder 3 there has thus far been a risk of soiling it.

Figure 3:
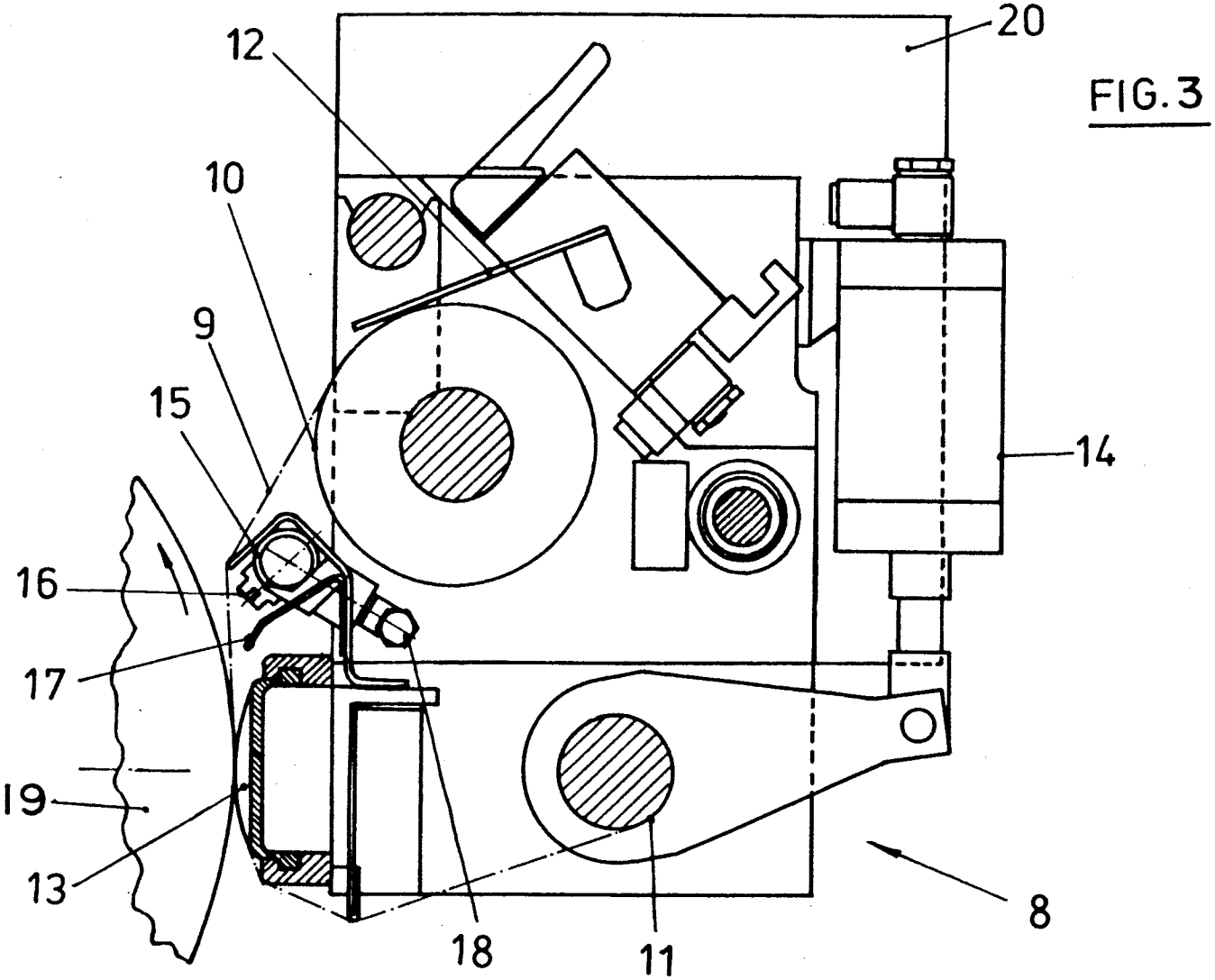
FIG. 3 shows a view on a larger scale of a wiping device associated with a bend cylinder.

In order to prevent soiling of the impression cylinder 3 the latter is provided with a wiping device 8, which wipes and simultaneously moistens its periphery so that it is kept clean and rendered ink repellent. The wiping device 8 is respectively located in a section of the periphery of the respective impression cylinder 3 which does not have the paper web 6 or 7 respectively, trained on it. In the case of the left hand twin printing unit 1 this is the part between the upward and downward runs of the paper web 6, while in the case of the right hand twin printing unit 2 the paper web 7 is supplied from the inside and removed in an outward direction. The wiping device 8 may therefore be placed in the part between the impression cylinder 3 and the associated blanket cylinder 4. In order however to ensure good accessibility of this part, in the case of the right hand twin printing unit 2 as well, the wiping device 8 is arranged adjacent to the outer side, that is to say at the side, remote from the other impression cylinder, of the respectively associated impression cylinder 3, as in also the case with the left hand twin printing unit 1. The paper web 7 is accordingly trained in the form of a loop 7a about the wiping unit 8. For this purpose there are bend rolls 19 fitting behind the wiping device and in difficult cases they may also have a wiping device of the type mentioned associated with them, as will be best seen in FIG. 3.

Figure 2:
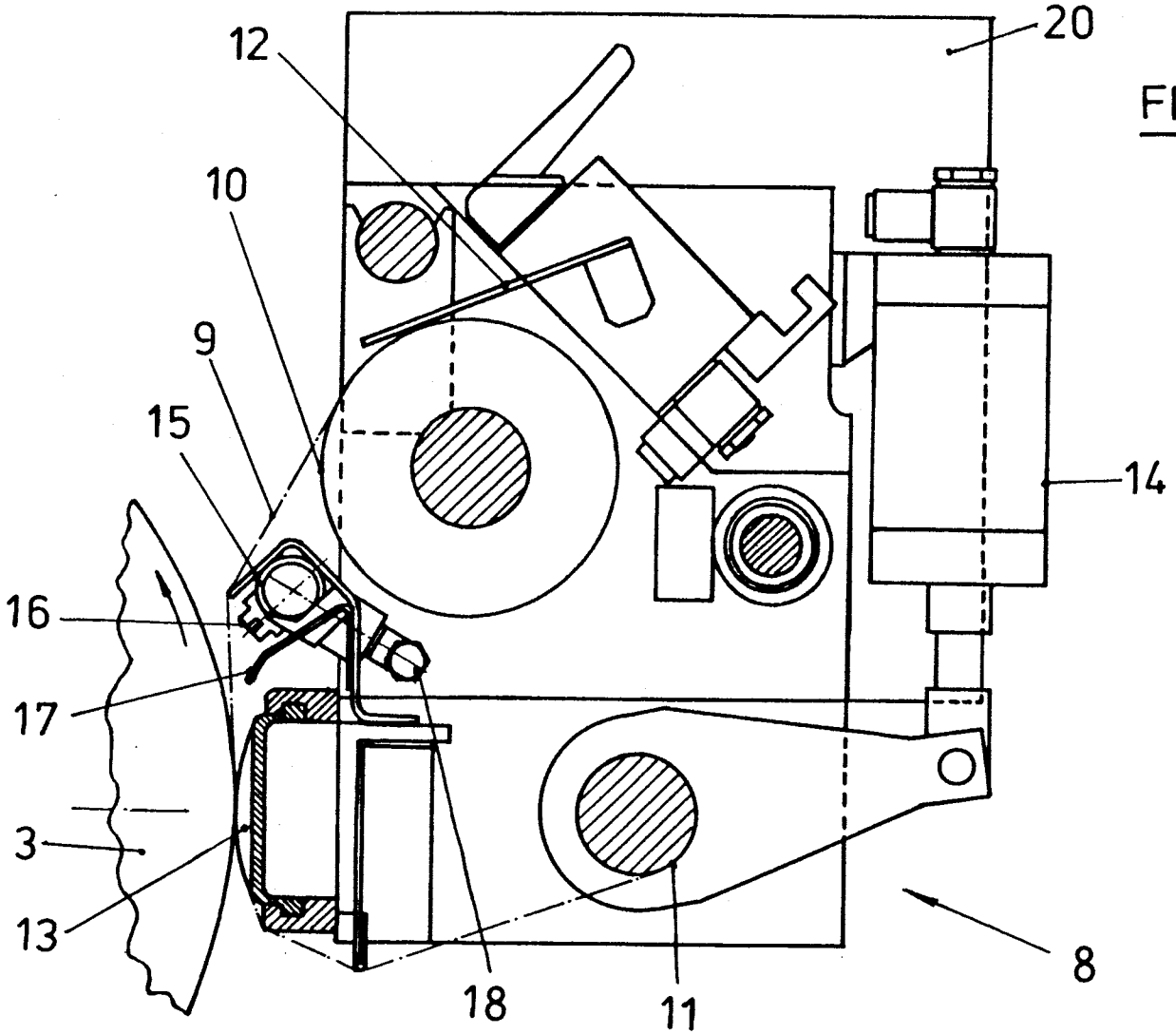
FIG. 2 shows a view on a larger scale of a wiping device associated with an impression cylinder.

The wiping device 8 comprises a wiping cloth 9 made of non-woven material, as will best be seen from FIG. 2, running from a supply roll 10 and able to be wound up on a take up roll 11. The supply roll 10 cooperates with a sensor 12 which causes a signal to be given whenever the supply of cloth runs out. In the part between the supply roll 10 and the take up roll 11 the wiping cloth 9 runs over a pressing part 13 opposite to the associated impression cylinder 3 and which brings a strip-like section of the wiping cloth 9 into engagement with the periphery of the associated impression cylinder 3. In the illustrated working example of the invention the pressing part 13 is in the form of an inflatable bellows, which in the inflated state presses the wiping cloth 9 against the impression cylinder 3. In the relieved state the wiping cloth 9 may come clear of the impression cylinder 3. This makes it possible to relieve the wiping cloth during cloth feed in a forward direction opposite to the direction of the associated impression cylinder. This feature means that the feed mechanism is relieved as well.

The feed of the wiping cloth 9 is in the present case caused by a lever mechanism with a drive cylinder 14 connected with the take up roll 11. The supply roll 10 may be provided with a brake or with a locking mechanism which is released on activation of the drive piston so that feed is enabled. The forward feed of the wiping cloth 9 takes place in steps. The desired number of steps per unit time may be set in accordance with the rate of soiling of the impression cylinder.

The wiping device 8 furthermore comprises a moistening device for the wiping cloth 9, which for its part is moisten the associated impression cylinder 3. In the present instance this moistening device consists of a bar 15 with jets, fitting behind the wiping cloth 9 and arranged over the zone of contact between the wiping cloth 9 and the impression cylinder 3. The spraying nozzles 16 of the bar are spaced out along it and directed obliquely downward towards the pressing part 13 with the wiping cloth 9 placed thereon. The spraying jets 16 have a sheet metal guard 17 placed under them, from whose edge placed over the point of contact between the wiping cloth 9 and the pressing part 13 and, respectively, the impression cylinder 14, the liquid may drip.

The jet bar 15 may have a collection chamber for all the jets 16 which is filled with moistening liquid which is forced out of it by compressed air to cause efficient atomization. The moistening of the wiping cloth 9 takes place in step with every feed motion of the cloth and if required in between two motions as well. The moistening liquid supplied is in this respect to be so metered out that the moisture film produced on the impression cylinder 3 does not weaken the paper web 6 or 7, respectively. The moistening liquid may be water. In the case of offset litho presses, as here, the moistening liquid may be the dampening fluid used in the dampening units. The moistening device 8 is accordingly connected with a tank in the case of dampening fluid or, in the case of operation from a public water supply, with a water main. Such connection may be via a connection pipe 18 provided with a screw connection sleeve.

The entire wiping unit 8 is mounted on a frame 20 with two lateral bearing housings connected with each other by cross members and which are detachably connected with the side frames of the printing press.

What is claimed is:

1. An apparatus for preventing soiling from printed material in the form of a paper web having fresh printing on one side thereof in a web-fed offset printing press, the printing press having at least one impression cylinder and at least one blanket cylinder associated therewith, and a plate dampening unit having dampening fluid associated therewith, comprising a cleaning device associated with each impression cylinder, said cleaning device including:

a wiping device comprising a wiping cloth;

pressing means for pressing the wiping cloth against its associated impression cylinder constantly during a printing operation; and moistening means for delivering a moistening liquid to the wiping cloth so that the associated impression cylinder can be wiped off and simultaneously provided with an ink-repelling film, said cleaning device being disposed in a region of the associated impression cylinder that does not contact the paper web, wherein the moistening liquid is the dampening fluid from the plate dampening unit of the printing press, and wherein the moistening means includes a dampening fluid connection.

2. The apparatus as defined in claim 1, wherein the pressing means includes a pressing part in the form of an inflatable bellows, and means for activating and deactivating the pressing part.

3. The apparatus as defined in claim 2, wherein the means for activating and deactivating the pressing part occurs in steps, and wherein the wiping device includes a supply roll and a take-up roll for the wiping cloth.

4. The apparatus as defined in claim 1, wherein the moistening means includes spray jets directed toward the wiping cloth, said spray jets being located upstream of the contact of the wiping cloth and its associated impression cylinder.

5. The apparatus as defined in claim 1, wherein the moistening means is adapted to intermittently deliver the moistening liquid to the wiping cloth.

6. The apparatus as defined in claim 1, wherein the moistening liquid is water, and wherein the moistening means includes a water connection.

7. The apparatus as defined in claim 1, wherein the web-fed offset printing press further has at least one bend roller, said apparatus further comprising a cleaning device associated with each bend roller, said cleaning device including:

a wiping device comprising a wiping cloth;

pressing means for pressing the wiping cloth against its associated bend roller; and moistening means for delivering a moistening liquid to the wiping cloth so that the associated bend roller can be wiped off and simultaneously provided with an ink-repelling film, said cleaning device being disposed in a region of the associated bend roller that does not contact the paper web.

8. The apparatus as defined in claim 1, wherein the cleaning device further includes at least one bend roll for the web fitted behind the wiping device.

* * * * *